US006045989A

United States Patent [19]

Ly et al.

[11] Patent Number: 6,045,989

[45] Date of Patent: Apr. 4, 2000

[54] COLOR PHOTOGRAPHIC SILVER HALIDE MATERIAL

[75] Inventors: Cuong Ly, Köln; Ralf Weimann, Leverkusen, both of Germany

[73] Assignee: Agfa-Gevaert NV, Belgium

[21] Appl. No.: 09/122,128

[22] Filed: Jul. 24, 1998

[30] Foreign Application Priority Data

Aug. 1, 1997 [DE] Germany ..... 197 33 246
Dec. 19, 1997 [DE] Germany ..... 197 56 737

[51] Int. Cl.[7] ..... G03C 1/08; G03C 7/26; G03C 7/32

[52] U.S. Cl. ..... 430/558; 430/604; 430/607; 430/608; 430/599; 430/567

[58] Field of Search ..... 430/599, 604, 430/607, 608, 558, 567

[56] References Cited

U.S. PATENT DOCUMENTS

| | | | |
|---|---|---|---|
| 3,615,620 | 10/1971 | Wilrijk et al. | 430/604 |
| 3,620,750 | 11/1971 | Riester | 430/604 |
| 4,269,927 | 5/1981 | Atwell | 430/604 |
| 4,885,233 | 12/1989 | Messing | 430/608 |
| 5,185,241 | 2/1993 | Inoue | 430/604 |
| 5,578,437 | 11/1996 | Asami et al. | 430/558 |

*Primary Examiner*—Geraldine Letscher
*Attorney, Agent, or Firm*—Connolly Bove Lodge & Hutz LLP

[57] ABSTRACT

A color photographic silver halide material having a support and at least one light-sensitive silver halide emulsion layer, the silver halide of which consists of at least 95 mole % of AgCl, and which contains a magenta coupler of formula (I)

(I)

wherein

R denotes H or a group which is split off under the conditions of chromogenic development, $R_1$ denotes alkyl, which is optionally substituted, and $R_2$ denotes $R_1$ or aryl, wherein the sum of all the C atoms of the $R_1$ and $R_2$ radicals in a coupler molecule is at least 12, and wherein the silver halide contains mercury, is distinguished by improved latent image stability.

11 Claims, No Drawings

COLOR PHOTOGRAPHIC SILVER HALIDE MATERIAL

This invention relates to a colour photographic silver halide material, the silver halide emulsions of which consist of at least 95 mole % of AgCl and which is distinguished by an improved latent image stability, particularly by an improved short-term latent image stability.

Exposed colour photographic silver halide material should provide sensitometric results which are as constant as possible during processing, irrespective of whether there are only a few seconds or many months between exposure and processing. For colour paper, this period of time is reduced to a few seconds to several days. This property is called latent image stability.

Colour photographic silver halide materials, the silver halide emulsions of which consist of at least 95 mole % of AgCl, frequently contain pyrazolotriazole magenta couplers of formula (I)

(I)

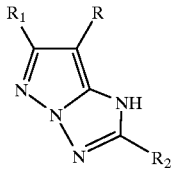

as magenta couplers, for reasons of colour brilliance and colour reproduction, wherein R denotes H or a group which is split off under the conditions of chromogenic development, $R_1$ denotes alkyl, which is optionally substituted, and $R_2$ denotes $R_1$ or aryl, wherein the sum of all the C atoms of the $R_1$ and $R_2$ radicals in a coupler molecule is at least 12.

The latent image stability of materials such as these is still not satisfactory. However, since the aforementioned magenta couplers are advantageous in principle, the object of the present invention was to develop a silver halide material which is based on silver halide emulsions with a high chloride content and which is provided with these couplers, and which is distinguished by an excellent latent image stability.

Surprisingly, this can be achieved by at least one silver halide of at least one silver halide emulsion containing mercury, particularly by doping the silver halide of at least one silver halide emulsion of the type cited at the outset with mercury.

By the expression "doping with mercury", it is to be understood that mercury compounds are added before precipitation is complete, so that the mercury compound, depending on the time of its addition, is situated substantially in the interior of the silver halide grains and is not simply situated on the surface—as in ripening.

The present invention therefore relates to a colour photographic silver halide material having a support and at least one light-sensitive silver halide emulsion layer, the silver halide of which consists of at least 95 mole % of AgCl, and which contains a magenta coupler of formula (I), characterised in that the silver halide contains mercury.

Suitable water-soluble salts of mercury correspond either to formula (II) or (III):

$$Hg(X_1)_2 \quad \text{(II)}$$

$$Hg(X_2) \quad \text{(III)},$$

wherein $X_1$ denotes a monovalent anion and $X_2$ denotes a divalent anion, for example fluoride, chloride, bromide, iodide, nitrate, cyanide, acetate, oxalate or sulphate.

The mercury salts are preferably used as an aqueous solution.

The mercury compound is preferably used in an amount of 1.0 to 30 $\mu$moles/mole of the respective silver halide.

In the silver halide emulsion layer which contains the mercury compounds (II) and/or (II), the photographic silver halide material preferably contains, most preferably in all the light-sensitive layers, a silver halide emulsion which consists of at least 95 mole % AgCl and contains less than 4 mole % AgI, and which in particular is free from silver iodide.

Ripening of the emulsions is effected firstly with gold compounds and secondly with sulphur and/or selenium compounds.

The emulsions according to the invention can be stabilised in the known manner with acidic NH or SH compounds. The stabilisers are preferably added after ripening and are selected so that they do not displace the sensitising dye or sensitising dyes from the emulsion grains of the silver chloride emulsion, and moreover so that they do not impede the bleaching of the image silver in the course of processing.

Ripening with sulphur is preferably effected using sodium thiosulphate as the ripening agent, although thioureas, isothiocyanates or thiophosphates can also be used as sulphur ripening agents.

Ripening with selenium is preferably effected using selenoureas, which are at least tri-substituted, with heterocyclic selenones which cannot be deprotonated into a selenolation, or with phosphane selenides, preferably with triarylphosphane selenides.

Ripening with gold is preferably effected using gold(III) chloride or a tetrachloroaurate salt which is reduced to a gold(I) compound in the course of ripening. This can be effected by the bisthioether added, for example. If the thioether is added jointly with the gold(III) salt, the bisthioether is presumably reduced, as the ligand, to form a gold(I) thioether-sulphoxide complex. The formation of gold(I) thioether-sulphoxide complexes from bisthioethers and gold (III) salts is known from the literature. It can be assumed that if they have a comparable nucleophilic effect, neither of the two sulphur atoms in the bisthioether is preferred.

Sulphur and/or selenium ripening on the one hand and gold ripening on the other hand can be effected jointly or in succession.

In addition, the emulsions may also contain other transition metal compounds of Group VIII of the periodic table in the form of dopants, which are added in order to achieve the desired gradation or to obtain the desired latent image behaviour, or to achieve a behaviour during, developing which is substantially free from reciprocity errors during or after the precipitation of the silver chloride. Examples include salts of rhodium(III) or iridium(III). The emulsions can also contain hexacyanoferrate(II) as a dopant.

In addition, the emulsions may also contain palladium(II) compounds, particularly tetrachloropalladates(II), which should improve their long-term stability.

In order to reduce fogging, the emulsions may also contain certain isothiazolone or isoselenazolone compounds, or disulphides or diselenides.

Chemical ripening, by sulphur or selenium compounds and gold, and spectral sensitisation can be effected separately or in one step.

The colour photographic silver halide material is preferably a copier material.

Photographic copier materials consist of a support on which at least one light-sensitive silver halide emulsion layer is deposited. Thin films and foils are particularly suitable as supports. A review of support materials and of the auxiliary layers which are deposited on the front and back thereof is given in Research Disclosure 37254, Part 1 (1995), page 285.

Colour photographic copier materials usually contain at least one red-sensitive, at least one green-sensitive and at least one blue-sensitive silver halide emulsion layer, and optionally contain intermediate layers and protective layers also.

Depending on the type of photographic material, these layers may be arranged differently. This will be illustrated using a colour negative paper as an example:

Colour photographic paper, which as a rule is considerably less sensitive to light than a colour photographic film is, usually comprise, in the following sequence on their support: a blue-sensitive, yellow-coupling silver halide emulsion layer, a green-sensitive, magenta-coupling silver halide emulsion layer and a red-sensitive, cyan-coupling silver halide emulsion layer. The yellow filter layer may be omitted.

The essential constituents of the photographic emulsion layers are binders, silver halide grains and colour couplers.

Information on suitable binders is given in Research Disclosure 37254, Part 2 (1995), page 286.

Information on suitable silver halide emulsions, their production, ripening, stabilisation and spectral sensitisation, including suitable spectral sensitisers, is given in Research Disclosure 37254, Part 3 (1995), page 286, and in Research Disclosure 37038, Part XV (1995), page 89.

Information on colour couplers is to be found in Research Disclosure 37254, Part 4 (1995), page 288, and in Research Disclosure 37038, Part II (1995), page 80. The maximum absorption of the dyes formed from the couplers and from the colour developer oxidation product preferably falls within the following ranges: yellow couplers 430 to 460 nm, magenta couplers 540 to 560 nm, cyan couplers 630 to 700 nm.

The colour couplers, which are mostly hydrophobic, and other hydrophobic constituents of the layers also, are usually dissolved or dispersed in high-boiling organic solvents. These solutions or dispersions are then emulsified in an aqueous binder solution (usually a gelatine solution), and after the layers have been dried are present as fine droplets (0.05 to 0.8 $\mu$m diameter) in the layers.

Suitable high-boiling organic solvents, methods of introduction into the layers of a photographic material, and other methods of introducing chemical compounds into photographic layers, are described in Research Disclosure 37254, Part 6 (1995), page 292.

The light-insensitive intermediate layers which are generally disposed between layers of different spectral sensitivity may contain media which prevent the unwanted diffusion of developer oxidation products from one light-sensitive layer into another light-sensitive layer which has a different spectral sensitivity.

Suitable compounds (white couplers, scavengers or DOP scavengers) are described in Research Disclosure 37254, Part 7 (1995), page 292, and in Research Disclosure 37038, Part III (1995), page 84.

The photographic material may additionally contain compounds which absorb UV light, brighteners, spreaders, filter dyes, formalin scavengers, light stabilisers, anti-oxidants, $D_{Min}$ dyes, additives for improving the dye-, coupler- and whiteness stability and to reduce colour fogging, plasticisers (latices), biocides and other substances.

Suitable compounds are given in Research Disclosure 37254, Part 8 (1995), page 292, and in Research Disclosure 37038, Parts IV, V, VI, VII, X, XI and XIII (1995), pages 84 et seq.

The layers of colour photographic materials are usually hardened, i.e. the binder used, preferably gelatine, is crosslinked by suitable chemical methods.

Instantaneous or rapid hardeners are usually used, wherein the expression "instantaneous or rapid hardeners" is to be understood to mean compounds which crosslink gelatine so that directly after it has been coated, or no later than a few days after it has been coated, hardening is complete to such an extent that no further change in the sensitometry and swelling of the composite layer occurs due to the crosslinking reaction. The term "swelling" is to be understood to mean the difference between the wet film thickness and the dry film thickness during the processing of the material.

Suitable instantaneous and rapid hardener substances are described in Research Disclosure 37254, Part 9 (1995), page 294, and in Research Disclosure 37038, Part XII (1995), page 86. Instantaneous or rapid hardeners are used in particular, in an amount of 1 to 10% by weight with respect to the gelatine to be hardened.

After image-by-image exposure, colour photographic materials are processed by different methods corresponding to their character. Details on the procedures used and the chemicals required therefor are published in Research Disclosure 37254, Part 10 (1995), page 294, and in Research Disclosure 37038, Parts XVI to XXIII (1995), page 95 et seq., together with examples of materials.

Examples of couplers of formula (I) include:

M-1

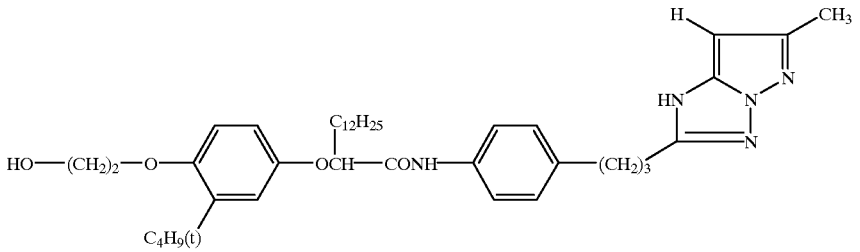

-continued
M-2
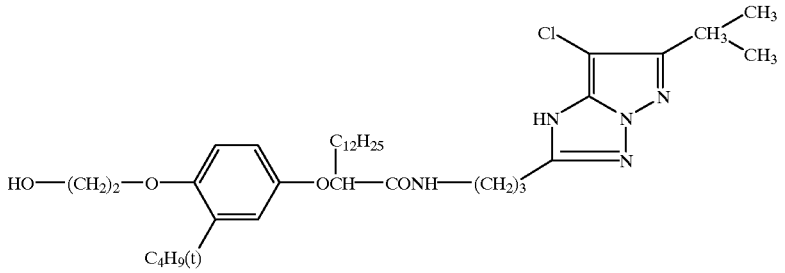
M-3
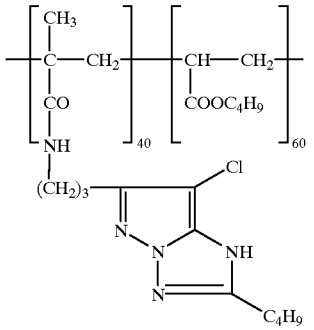
M-4
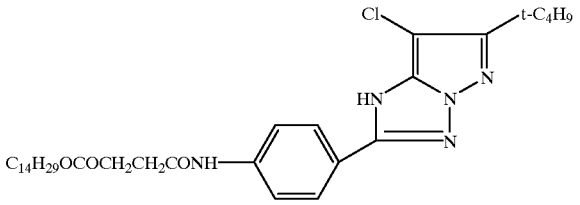
M-5
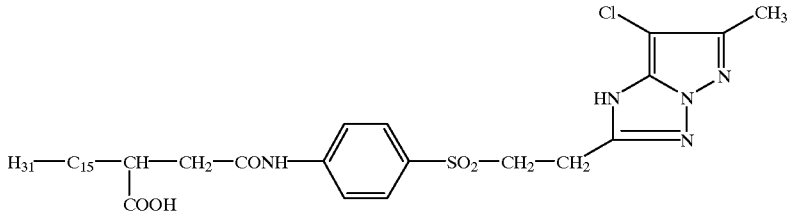
M-6
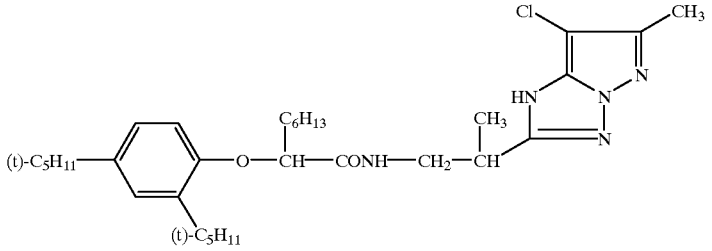

-continued
M-7
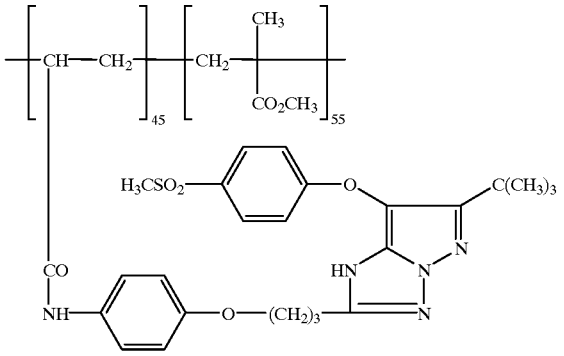
M-8
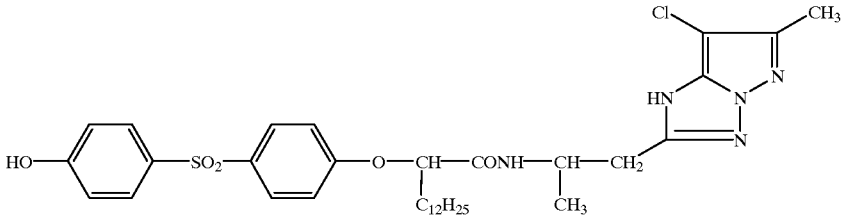
M-9
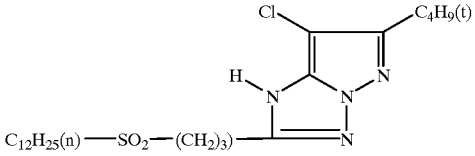
M-10
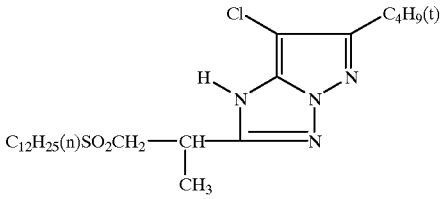
M-11
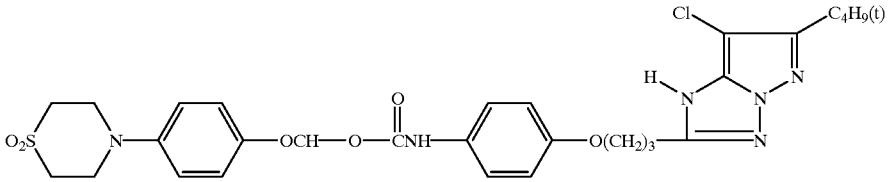
M-12
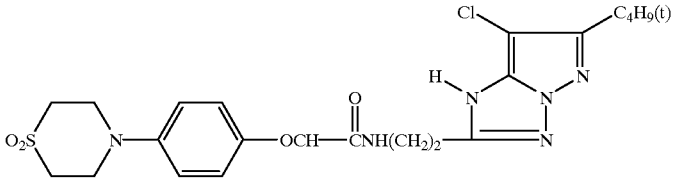

-continued

M-13

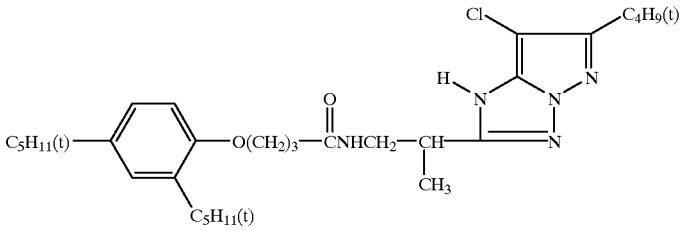

PRODUCTION OF THE SILVER HALIDE EMULSION

A: Blue-sensitive emulsions

Emulsion A-1

The following solutions were each made up with demineralised water:

| | | |
|---|---|---|
| solution 11 | 1100 g | water |
| | 140 g | gelatine |
| solution 12 | 1860 g | water |
| | 360 g | NaCl |
| solution 13 | 1800 g | water |
| | 1000 g | $AgNO_3$. |

Solutions 12 and 13 were added simultaneously over 300 minutes at 50° C., with intensive stirring and at a pAg of 7.7, to solution 11. A silver chloride emulsion with an average particle diameter of 0.85 μm was obtained. The gelatine/$AgNO_3$ weight ratio was 0.14. The emulsion was subjected to ultrafiltration, washed and redispersed with an amount of gelatine such that the gelatine/$AgNO_3$ weight ratio was 0.56. The emulsion was ripened at a pH of 5.3 and at a temperature of 50° C., using the optimum amount of gold(III) chloride and the optimum amount of $Na_2S_2O_3$. After chemical ripening, the emulsion was spectrally sensitised at 50° C. with 1.4 g of compound (AI)/kg Ag, was stabilised with 0.5 g of compound (AII)/kg Ag, and was subsequently treated with 0.6 mole % KBr (with respect to silver nitrate).

AI:

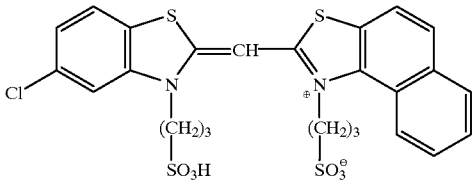

AII:

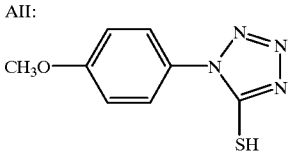

Emulsion A-2

The procedure was as for emulsion A-1, except that 10.5 mg $HgSO_4$ was added to solution 11. The emulsion contained 6 μmoles $Hg^{2+}$/mole $AgNO_3$.

B: Green-sensitive emulsions

Emulsion B-1

The following solutions were each made up with demineralised water:

| | | |
|---|---|---|
| solution 21 | 1000 g | water |
| | 140 g | gelatine |
| solution 22 | 1650 g | water |
| | 360 g | NaCl |
| | 0.11 mg | $Na_3RhCl_6$ |
| solution 23 | 1600 g | water |
| | 1000 g | $AgNO_3$. |

Solutions 22 and 23 were added simultaneously over 105 minutes at 60° C., with intensive stirring and at a pAg of 7.7, to solution 21. A silver chloride emulsion with an average particle diameter of 0.40 μm was obtained. The gelatine/$AgNO_3$ weight ratio was 0.14. The emulsion was subjected to ultrafiltration, washed and redispersed with an amount of gelatine such that the gelatine/$AgNO_3$ weight ratio was 0.56.

The emulsion was ripened at a temperature of 60° C. and at a pH of 5.3 for 3 hours, using the optimum amount of gold(III) chloride and the optimum amount of $Na_2S_2O_3$. After chemical ripening, the emulsion was spectrally sensitised at 50° C. with 2 g of compound (BI)/kg Ag, and was stabilised with 1.0 g of compound (BII)/kg Ag. 0.003 mole KBr/mole $AgNO_3$ was subsequently added.

B-I:

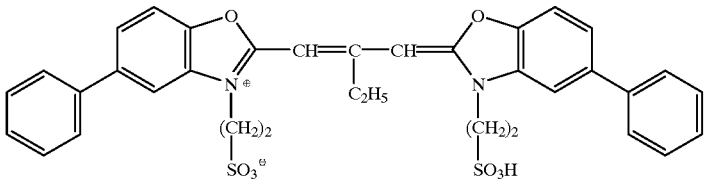

B-II:

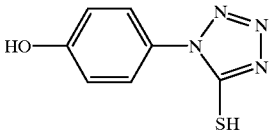

Emulsion B-2

The procedure was as for emulsion B-1, except that 100 ml of an aqueous solution which contained 19.1 mg $Hg(NO_3)_2$ was add over 5 minutes after a time of precipitation of 50 minutes. The emulsion contained an intermediate zone containing $Hg^{2+}$ and a total amount of 10 $\mu$moles $Hg^{2+}$/mole $AgNO_3$.

Emulsion B-3

The procedure was as for emulsion B-2, except that the aqueous solution contained 57.3 mg $Hg(NO_3)_2$. The emulsion contained a total amount of 30 $\mu$moles $Hg^{2+}$/mole $AgNO_3$.

C: Red-sensitive emulsions

Emulsion C-1

This was produced analogously to B-1.

After chemical ripening, the emulsion was spectrally sensitised at 40° C. with 150 mg of compound (CI)/kg Ag, and was stabilised with 2 g of compound (CII)/kg Ag. 0.003 moles KBr/mole $AgNO_3$ were subsequently added.

C-I:

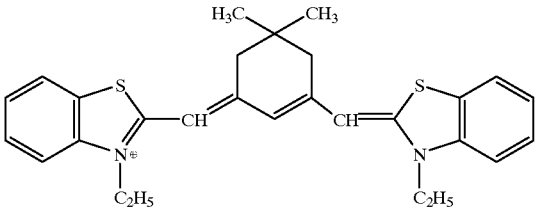

C-II:

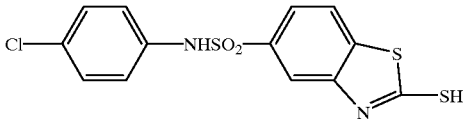

Emulsion C-2

The procedure was as for emulsion C-1, except that 1.5 mg $Hg(CN)_2$ were added to solution 23. The emulsion contained a total amount of 1 $\mu$mole $Hg^{2+}$/mole $AgNO_3$.

Layer structure 1

A colour photographic recording material suitable for a rapid processing procedure was produced by depositing the following layers in the given sequence on a film base comprising paper coated on both sides with polyethylene. The quantitative data are given with respect to 1 $m^2$ in each case. The corresponding amounts of $AgNO_3$ are quoted for silver halide deposition.

| | |
|---|---|
| Layer 1: | (substrate layer) |
| | 0.2 g gelatine |
| Layer 2: | (blue-sensitive layer) |
| | blue-sensitive silver halide emulsion A-1, |
| | comprising 0.40 g $AgNO_3$, with |
| | 0.96 g gelatine |
| | 0.55 g yellow coupler Y-1 |
| | 0.21 g tricresyl phosphate (TCP) |
| | 0.11 g dye stabiliser ST-1 |
| Layer 3: | (protective layer) |
| | 1.02 g gelatine |
| | 0.05 g 2,5-di-tert.-octylhydroquinone |
| | 0.10 g TCP |
| | 0.05 g compound SC-1 |
| Layer 4: | (green-sensitive layer) |
| | green-sensitive silver halide emulsion B-1, |
| | comprising 0.20 g $AgNO_3$, with |
| | 0.66 gelatine |
| | 0.20 g magenta coupler M-1 |
| | 0.10 g compound SC-1 |
| | 0.25 g coupler solvent K-1 |
| | 0.05 mg dye stabiliser ST-2 |
| Layer 5 | (protective layer) |
| | 1.02 g gelatine |
| | 0.48 g UV absorber UV-1 |
| | 0.08 g UV absorber UV-2 |
| | 0.28 g coupler solvent K-2 |
| | 0.025 g di-tert.-octylhydroquinone |
| | 0.025 g compound SC-1 |
| | 0.05 g TCP |
| Layer 6 | (red-sensitive layer) |
| | red-sensitive silver halide emulsion C-1, |
| | comprising 0.29 g $AgNO_3$, with |
| | 0.85 g gelatine |
| | 0.41 g cyan coupler C-1 |
| | 0.41 g TCP |
| Layer 7 | (protective layer) |
| | 0.33 g gelatine |
| | 0.15 g UV absorber UV-1 |
| | 0.03 g UV absorber UV-2 |
| | 0.09 g coupler solvent K-2 |
| Layer 8 | (protective layer) |
| | 0.92 g gelatine |
| | 0.34 g hardener H-1 |

The following compounds were used in sample 1:

Y-1
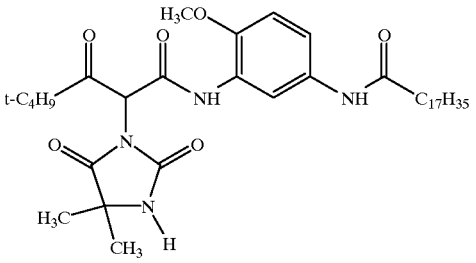
C-1
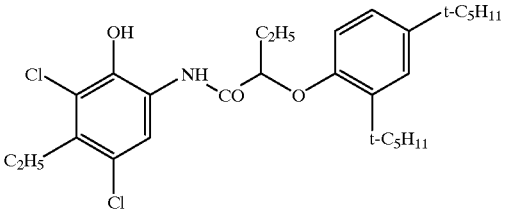
SC-1
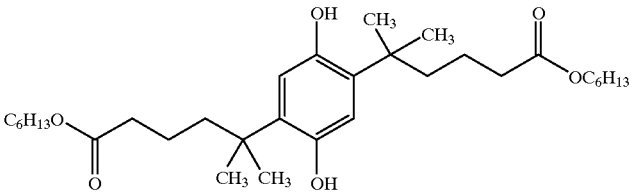
UV-1
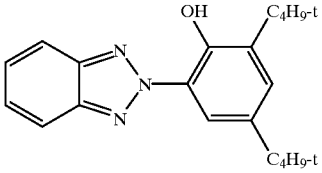
UV-2
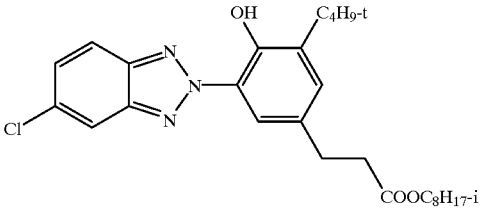
H-1
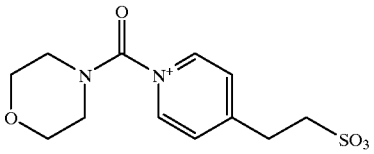
K-1
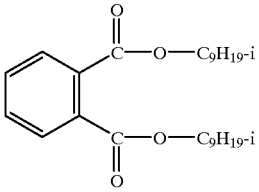
K-2
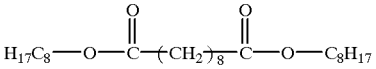

-continued

ST-1

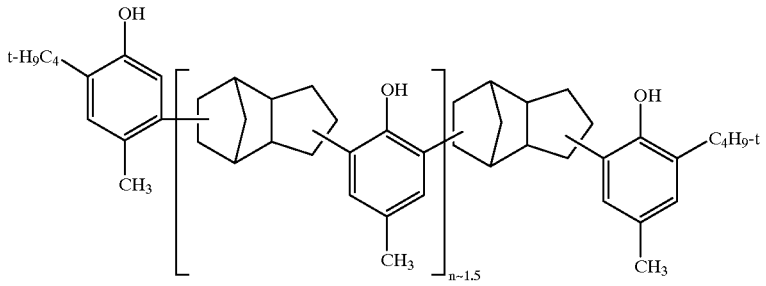

ST-2

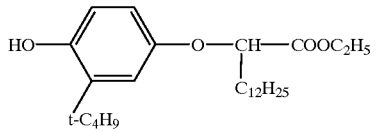

Processing

The samples were subsequently exposed for 40 ms behind a step wedge and were processed as follows, using process AP 94:

| | |
|---|---|
| a) Colour developer - 45 sec. - 35° C. | |
| triethanolamine | 9.0 g |
| N,N-diethylhydroxylamine | 4.0 g |
| diethylene glycol | 0.05 g |
| 3-methyl-4-amino-N-ethyl-N-methanesulphonamidoethyl aniline sulphate | 5.0 g |
| potassium sulphite | 0.2 g |
| triethylene glycol | 0.05 g |
| potassium carbonate | 22 g |
| potassium hydroxide | 0.4 g |
| ethylenediaminetetraacetic acid, disodium salt | 2.2 g |
| potassium chloride | 2.5 g |
| 1,2-dihydroxybenzene-3,4,6,-trisulphonic acid, trisodium salt | 0.3 g |
| made up with water to 1000 ml; pH 10.0. | |
| b) Bleach-hardener - 45 sec. - 35° C. | |
| ammonium thiosulphate | 75 g |
| sodium hydrogen sulphate | 13.5 g |
| ammonium acetate | 2.0 g |
| ethylenediaminetetraacetic acid (iron ammonium salt) | 57 g |
| 25% ammonia | 9.5 g |
| made up with vinegar to 1000 ml; pH 5.5 | |

c) Washing—2 min. -33° C.

d) Drying

Layer structure 2

Emulsion A1 was replaced by emulsion A2, emulsion B1 was replaced by emulsion B2 and emulsion C1 was replaced by emulsion C2, in the same amount of $AgNO_3$ in each case.

Layer structure 3

As for layer structure 2, except with emulsion B3 instead of emulsion B2 in the same amount of $AgNO_3$.

The sensitivity difference ΔlogI.t×1000 for blue ($\Delta E_b$), green ($\Delta E_g$) and red light ($\Delta E_r$) was determined from the sensitivity on processing 24 hours after exposure minus the sensitivity on processing 60 seconds after exposure, at a density of 0.6 in each case. The lower the value, the better is the latent image stability.

| Layer structure | $\Delta E_b$ | $\Delta E_g$ | $\Delta E_r$ | Remarks |
|---|---|---|---|---|
| 1 | 25 | 40 | 22 | comparison |
| 2 | 8 | 12 | 4 | invention |
| 3 | 4 | 6 | 4 | invention |

The mercury-doped emulsions of layers structures 2 and 3 exhibited a considerably better latent image stability.

What is claimed is:

1. The color photographic silver halide material which comprises a support and at least one light-sensitive silver halide emulsion layer, the silver halide of which consists essentially of at least 95 mol % of AgCl, and which contains a magenta coupler of formula (I)

(I)

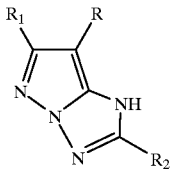

wherein

R denotes H or a group which is split off under the conditions of chromogenic development, $R_1$ denotes alkyl, which is optionally substituted, and $R_2$ denotes $R_1$ or aryl, wherein the sum of all the C atoms of the $R_1$ and $R_2$ radicals in a coupler molecule is at least 12, and the silver halide is doped with mercury.

2. The color photographic silver halide material according to claim 1, wherein the mercury compound corresponds to one of formulae (II) or (III):

$$Hg(X_1)_2 \quad \text{(II)}$$

$$Hg(X_2) \quad \text{(III)}$$

wherein $X_1$ denotes a monovalent anion and $X_2$ denotes a divalent anion.

3. The color photographic silver halide material according to claim 1, wherein the silver halide material is hardened with an instantaneous or rapid hardener.

4. The color photographic silver halide material according to claim 1, wherein the mercury compound is used in an amount of 1.0 to 30 μmoles/mole of the respective silver halide.

5. The color photographic silver halide material according to claim 3, wherein the instantaneous or rapid hardener is used in an amount of 1 to 10% by weight with respect to the gelatine to be hardened.

6. The color photographic silver halide material according to claim 1, wherein the silver halide emulsions of all the silver halide emulsion layers consist essentially of at least 95 mole % AgCl and of 4 mole % AgI at most.

7. The color photographic silver halide material according to claim 2, wherein $X_1$ is fluoride, chloride, bromide, iodide, nitrate, cyanide or acetate and $X_2$ is oxalate or sulfate.

8. A process to produce a colored photographic silver halide material which comprises doping at least one silver halide emulsion layer with mercury, wherein the silver halide of the silver halide emulsion layer consists essentially of at least 95 mol % of AgCl, and which contains a magenta coupler of formula (I)

(I)

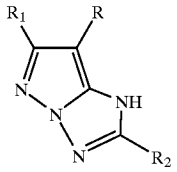

wherein

R denotes H or a group which is split off under the conditions of chromogenic development, $R_1$ denotes alkyl, which is optionally substituted, and $R_2$ denotes $R_1$ or aryl, wherein the sum of all the C atoms of the $R_1$ and $R_2$ radicals in the coupler molecule is at least 12.

9. The process as claimed in claim 8, wherein said mercury is a water soluble salt corresponding to either formula (II) or (III):

$$Hg(X_1)_2 \quad \text{(II)}$$

$$Hg(X_2) \quad \text{(III)}$$

wherein $X_1$ denotes a monovalent anion and $X_2$ denotes a divalent anion.

10. The process as claimed in claim 9, wherein $X_1$ is fluoride, bromide, iodide, nitrate, cyanide or acetate and $X_2$ is oxalate or sulfate.

11. The process as claimed in claim 10, wherein the mercury compound is used in amount of 1.0 to 30 μmoles/mol of the silver halide.

* * * * *